US009151080B2

(12) United States Patent
Saunders et al.

(10) Patent No.: US 9,151,080 B2
(45) Date of Patent: Oct. 6, 2015

(54) PRIVACY LATCH

(75) Inventors: John David Saunders, Queensland (AU); Yan Gao Wu, Zhongshan (CN)

(73) Assignee: Jacou Industry Zhongshan Limited, Zhongshan, Guangdong (CN)

( * ) Notice: Subject to any disclaimer, the term of this patent is extended or adjusted under 35 U.S.C. 154(b) by 0 days.

(21) Appl. No.: 13/474,569

(22) Filed: May 17, 2012

(65) Prior Publication Data

US 2012/0292923 A1 Nov. 22, 2012

(30) Foreign Application Priority Data

May 18, 2011 (AU) ..... 2011901916

(51) Int. Cl.

| | |
|---|---|
| ***E05C 5/00*** | (2006.01) |
| ***E05B 65/08*** | (2006.01) |
| ***E05B 15/02*** | (2006.01) |
| *E05B 65/00* | (2006.01) |

(52) U.S. Cl.

CPC ..... *E05B 65/0817* (2013.01); *E05B 15/022* (2013.01); *E05C 5/00* (2013.01); *E05B 65/0035* (2013.01); *Y10T 292/0914* (2015.04); *Y10T 292/0915* (2015.04)

(58) Field of Classification Search

CPC . E05B 65/0035; E05B 65/08; E05B 65/0811; E05B 65/0817; E05B 65/087; E05C 5/00; E05C 5/02

USPC ..... 292/95, 109–111, 121–124, DIG. 46, 292/57, 58, 60–62, 63–66, 69, 96–98, 129, 292/139, 140, 165, 167, 169, 169.23, 292/169.19, 182, 190–192, 194, 196, 197, 292/222, 223, 226, 240, 336.5, DIG. 24, 292/DIG. 52, 113, 126, 100, 166, 173, 177, 292/179, 181, 143, 219, 220, 221, 224, 229, 292/195, 200; 70/95, 99, 100, DIG. 52

See application file for complete search history.

(56) References Cited

U.S. PATENT DOCUMENTS

| | | | | | |
|---|---|---|---|---|---|
| 2,017,564 | A | * | 10/1935 | Claud-Mantle | 292/110 |
| 2,062,597 | A | * | 12/1936 | Moore | 292/110 |
| 2,136,662 | A | * | 11/1938 | Anderson | 292/64 |
| 2,252,591 | A | * | 8/1941 | Anderson | 292/63 |
| 2,379,050 | A | * | 6/1945 | Voight | 292/5 |
| 2,405,240 | A | * | 8/1946 | Shearer et al. | 70/100 |
| 2,648,559 | A | * | 8/1953 | Sinclair et al. | 292/66 |
| 2,714,751 | A | * | 8/1955 | Stuart et al. | 52/582.2 |
| 2,736,185 | A | * | 2/1956 | Collar | 70/100 |

(Continued)

FOREIGN PATENT DOCUMENTS

| | | | |
|---|---|---|---|
| AU | 200072374 B2 | | 8/2001 |
| GB | 1163398 A | * | 9/1969 |

(Continued)

*Primary Examiner* — Alyson M Merlino

(74) *Attorney, Agent, or Firm* — Alleman Hall McCoy Russell & Tuttle LLP

(57) ABSTRACT

The present disclosure relates to the field of door fittings, particularly door fittings comprising a privacy latch for a sliding door. In one particular aspect the present disclosure is suitable for use for securing interior or exterior doors, including doors for bathrooms, changing rooms, shower or toilet cubicles to give users the option of privacy. The present disclosure stems from the realization that smooth movement of a latch hook between a locked and unlocked condition can be obtained by use of a guide.

12 Claims, 5 Drawing Sheets

(56) References Cited

U.S. PATENT DOCUMENTS

| | | | | | |
|---|---|---|---|---|---|
| 2,741,341 | A | * | 4/1956 | Anderson | 312/406.2 |
| 2,742,309 | A | * | 4/1956 | Hillgren | 292/100 |
| 2,784,019 | A | * | 3/1957 | Des Combes | 292/111 |
| 2,789,852 | A | * | 4/1957 | Eads | 292/110 |
| RE24,443 | E | * | 3/1958 | Labrie | 70/96 |
| 2,923,145 | A | * | 2/1960 | Labrie | 70/97 |
| 2,924,475 | A | * | 2/1960 | Russell | 292/129 |
| 2,926,037 | A | * | 2/1960 | Granzow | 292/113 |
| 2,928,689 | A | * | 3/1960 | Mineah | 292/113 |
| 2,980,458 | A | * | 4/1961 | Russell | 292/113 |
| 3,041,097 | A | * | 6/1962 | Eads | 292/113 |
| 3,105,711 | A | * | 10/1963 | Woodworth et al. | 292/113 |
| 3,207,544 | A | * | 9/1965 | Miller | 292/109 |
| 3,360,290 | A | * | 12/1967 | De Gray | 292/6 |
| 3,437,363 | A | * | 4/1969 | Walters | 292/113 |
| 3,437,364 | A | * | 4/1969 | Walters | 292/113 |
| 3,565,469 | A | * | 2/1971 | Zwart | 52/582.2 |
| 3,958,822 | A | * | 5/1976 | Germer | 292/113 |
| 4,132,438 | A | * | 1/1979 | Guymer | 292/111 |
| 4,417,430 | A | * | 11/1983 | Loikitz | 52/582.2 |
| 5,452,928 | A | | 9/1995 | Donald | |
| 5,529,351 | A | | 6/1996 | Donald | |
| 5,563,483 | A | * | 10/1996 | Kowall et al. | 318/283 |
| 5,595,409 | A | | 1/1997 | Fier et al. | |
| 5,653,483 | A | * | 8/1997 | Grover | 292/194 |
| 5,816,629 | A | | 10/1998 | Donald | |
| 6,443,504 | B1 | * | 9/2002 | Donald | 292/110 |
| 6,702,340 | B2 | * | 3/2004 | Donald | 292/110 |
| 2008/0238109 | A1 | * | 10/2008 | Huang | 292/95 |

FOREIGN PATENT DOCUMENTS

| | | | | |
|---|---|---|---|---|
| GB | 1167125 | A | * | 10/1969 |
| NZ | 301389 | | | 3/1999 |
| NZ | 509090 | A | | 4/2002 |
| NZ | 512653 | A | | 4/2002 |
| NZ | 512654 | A | | 4/2002 |
| NZ | 573537 | A | | 4/2011 |

* cited by examiner

Fig 1a
Fig 1b
Fig 1c
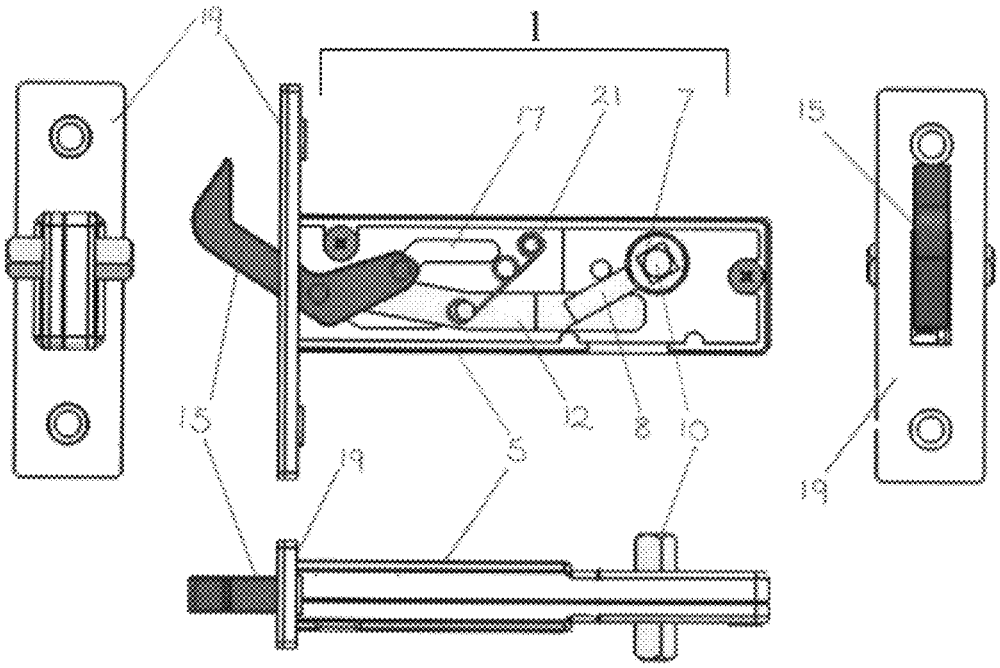
Fig 1d
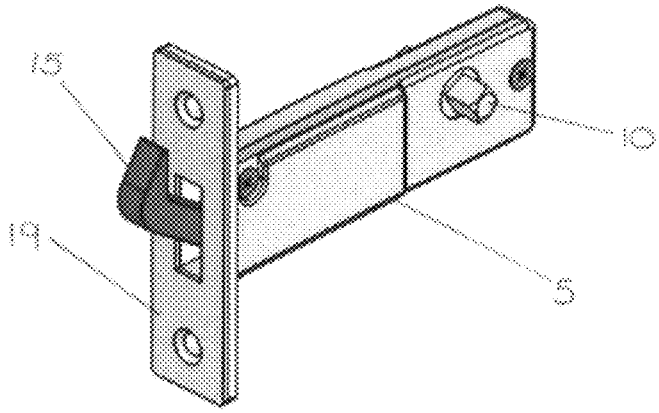
Fig 1e
Figure 1

Figure 1 (cont.d)

Fig 2a
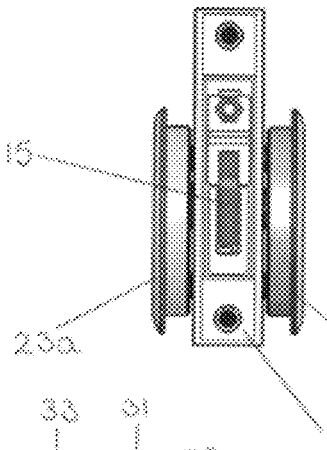
Fig 2b
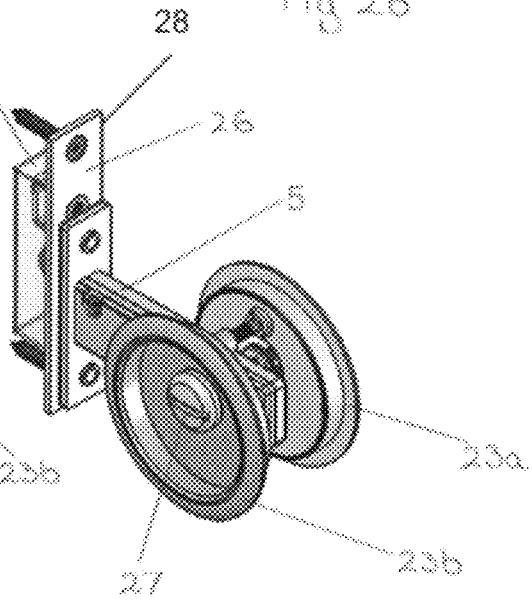
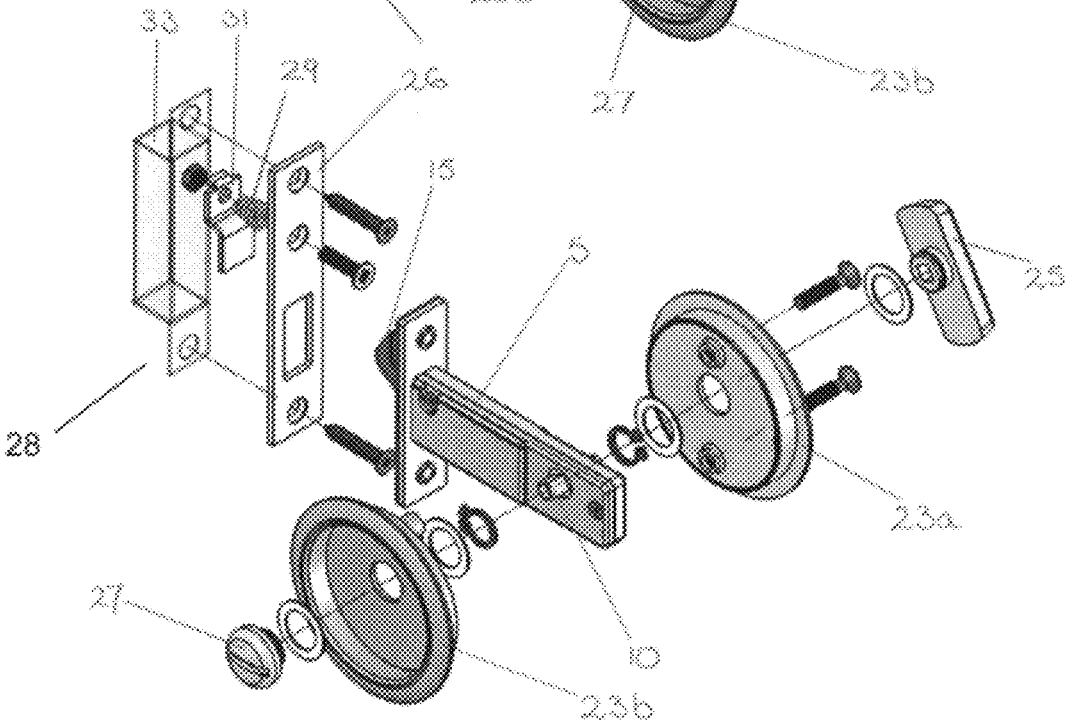
Fig 2c
Figure 2

Fig 3a
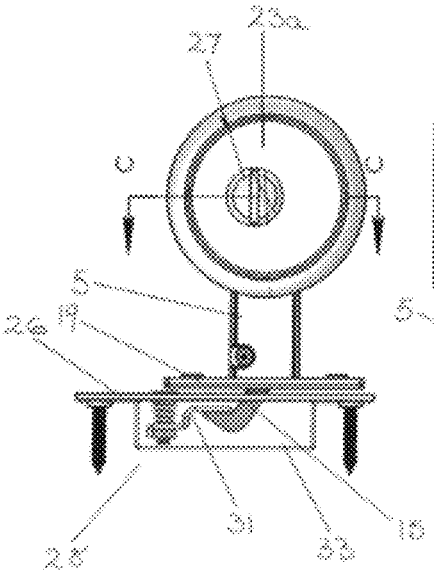
Fig 3b
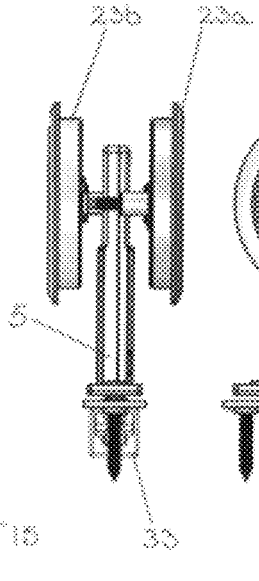
Fig 3c
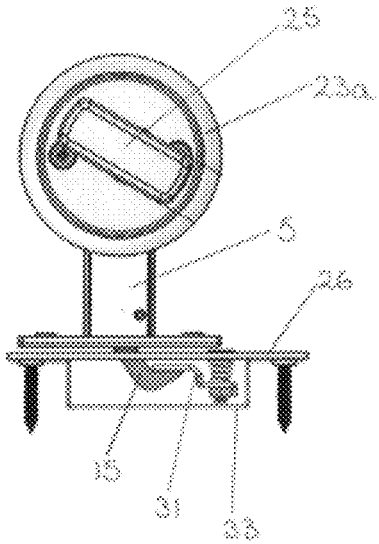
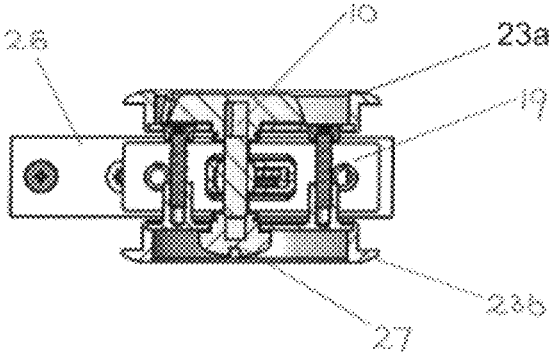
Fig 3d
Figure 3

PRIVACY LATCH

RELATED APPLICATIONS

The present application claims priority to Australian Provisional Patent Application Number 2011901916, filed on May 18, 2011, the entire contents of which are hereby incorporated by reference for all purposes.

FIELD

The present disclosure relates to the field of door fittings, particularly door fittings comprising a privacy latch for a sliding door.

In one particular aspect the present disclosure is suitable for use for securing interior or exterior doors, including doors for bathrooms, changing rooms, shower or toilet cubicles to give users the option of privacy.

It will be convenient to hereinafter describe example embodiments in relation to specific types of doors, however it should be appreciated that the present disclosure is not limited to that use only and can be used in a wide range of applications.

BACKGROUND ART

It is to be appreciated that any discussion of documents, devices, acts or knowledge in this specification is included to explain the context of the present disclosure. Further, the discussion throughout this specification comes about due to the realisation of the inventor and/or the identification of certain related art problems by the inventor. Moreover, any discussion of material such as documents, devices, acts or knowledge in this specification is included to explain the context of the disclosure in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure and claims herein.

Doors normally require a latch mechanism so that they can be secured in the closed position. Interior doors tend to have a simple latch, the main body of which is located adjacent to the closing edge of the door. The latch can be manually operated by a handle, such as a lever or knob that turns, moving an internal latch mechanism. As the handle is moved, a latch hook engages/disengages with a plate that is attached to the door jamb or door frame, thus securing/releasing the door.

Sliding door locks often do not include protruding handles such as levers or knobs, for aesthetic or practical reasons. In particular, protruding handles are not suitable for use with cavity sliding doors, that is, door panels which are typically hidden from view by sliding them into a wall cavity. Protruding handles would stop the door from being entirely slid into the cavity, or particularly large wall cavities would be required.

Protruding door handles are therefore often replaced by a pair of recessed cups mounted on either side of the door panel, one of the cups housing an actuation lever and the other typically including an emergency release device. The lever is manually rotated to extend or retract a bolt from the face plate. A strike plate is mounted on the door frame opposite the closing edge of the door and includes an opening complimentary to the bolt. When the door is closed, the bolt can be extended from the latch body, which in turn causes the hook to extend from the bolt and engage the strike plate to retain the door in the closed position. To open the door, the hook disengages from the strike plate and retracts into the bolt, and the bolt in turn retracts into the latch body.

Sliding door locks generally include a lock bolt of generally rectangular cross section with a longitudinal axis parallel to the side edges of the door and a transverse axis normal to the bottom and top edges of the door.

For example Australian patent 782549 (Gainsborough Hardware Industries Ltd), U.S. Pat. Nos. 5,452,928, 5,529,351 and 5,816,629 disclose cavity sliding door locks in which the hook extends from and retracts into, the bolt.

SUMMARY

An object of the present disclosure is to provide a smooth operating lock having reduced parts.

A further object of the present disclosure is to alleviate at least one disadvantage associated with the related art.

It is an object of the embodiments described herein to overcome or alleviate at least one of the above noted drawbacks of related art systems or to at least provide a useful alternative to related art systems.

In a first aspect of embodiments described herein there is provided a lock for a sliding door, the lock comprising:

- a drive member supported by a latch body, the drive member being adapted for movement in response to rotation of a spindle;
- a link for imparting movement between the drive member and a hook, wherein the hook movement is in association with a guide on the latch body.

Typically, the hook moves between a position in which it is at least partially extended from the latch body and a position in which it is at least partially retracted within the latch body.

In a particular embodiment the guide is configured such that the hook movement is between,

- a first position (locked position) in which the hook extends from the latch body and engages the strike plate,
- a second position in which the hook is disengaged from the strike plate, and
- a third position (unlocked position) in which the hook is at least partially retracted, including fully retracted within the latch body.

For example, the guide may have a first part associated with horizontal movement and a second part associated with vertical movement of the hook. Alternatively, the guide may have a first part associated with vertical movement and a second part associated with horizontal movement of the hook.

The guide may be of any convenient configuration. For example, the guide may comprise a slot in the latch body, the slot adapted to slidably receive one or more suitably shaped protrusion(s) on the hook. Alternatively, the guide may comprise a slot in the hook which slides along one or more suitably shaped protrusion(s) on the latch body.

In another aspect of embodiments described herein there is provided a lock for a sliding door, the lock comprising:

- a drive member supported by a latch body, the drive member being adapted for movement in response to rotation of a spindle;
- a link for imparting movement between the drive member and a hook, the link having a first end cooperating with a cam on the drive member and a second end cooperating with the hook, wherein the hook movement is in association with a guide on the latch body.

In another aspect of the embodiments described herein there is provided a lock for a sliding door, the lock comprising:

a drive member supported by a latch body, the drive member being adapted for movement in response to rotation of a spindle;

a hook having a first end adapted to engage and disengage from a strike plate in a door frame and a second end received by one or more guides in the latch body, a link for imparting movement between the drive member and a hook, the link having a first end cooperating with a cam on the drive member and a second end cooperating with the hook, wherein in use, an over center means urges the hook between a locked position engaging the strike plate and an unlocked position.

It will be readily apparent to the person skilled in the art that the latch of the present disclosure is suitable for use with a closure panel of any convenient material such as timber, glass, metal and the like or combinations of materials.

The latch body is typically of rectangular cross section, having parallel top and bottom surfaces, and parallel first and second sides.

Other aspects are disclosed in the specification and/or defined in the appended claims, forming a part of the disclosure.

In essence, embodiments of the present disclosure stem from the realization that smooth movement of a latch hook between a locked and unlocked condition can be obtained by use of a guide. Furthermore embodiments of the present disclosure stem from the realisation that shorter travel of the handle can still successfully lock and unlock the latch, an action that can be made easier with spring assistance.

Advantages provided by the present disclosure comprise the following:

Reduction in the number of moving parts, and therefore the inventory of parts required to provide a smooth operating latch; and Use of an adjustable striker allows better alignment of the latch to a door frame.

Further scope of applicability of embodiments of the present disclosure will become apparent from the detailed description given hereinafter. However, it should be understood that the detailed description and specific examples, while indicating example embodiments of the disclosure, are given by way of illustration only, since various changes and modifications within the spirit and scope of the disclosure herein will become apparent to those skilled in the art from this detailed description.

BRIEF DESCRIPTION OF THE DRAWINGS

Further disclosure, objects, advantages and aspects of example and other embodiments of the present application may be better understood by those skilled in the relevant art by reference to the following description of embodiments taken in conjunction with the accompanying drawings, which are given by way of illustration only, and thus are not limitative of the disclosure herein, and in which:

FIG. 2 illustrates the latch body of FIG. 1 in combination with a manual means for opening and closing the latch and a strike plate for engagement with the hook in front view (FIG. 2*a*), perspective view (FIG. 2*b*) and exploded plan view (FIG. 2*c*);

FIG. 3 illustrates the latch body and manual opening and closing means of FIG. 2 in left side view (FIG. 3*a*), top view (FIG. 3*b*), right side view (FIG. 3*c*) and cross-sectional view in the direction C-C (FIG. 3*d*)

Figure 1F:
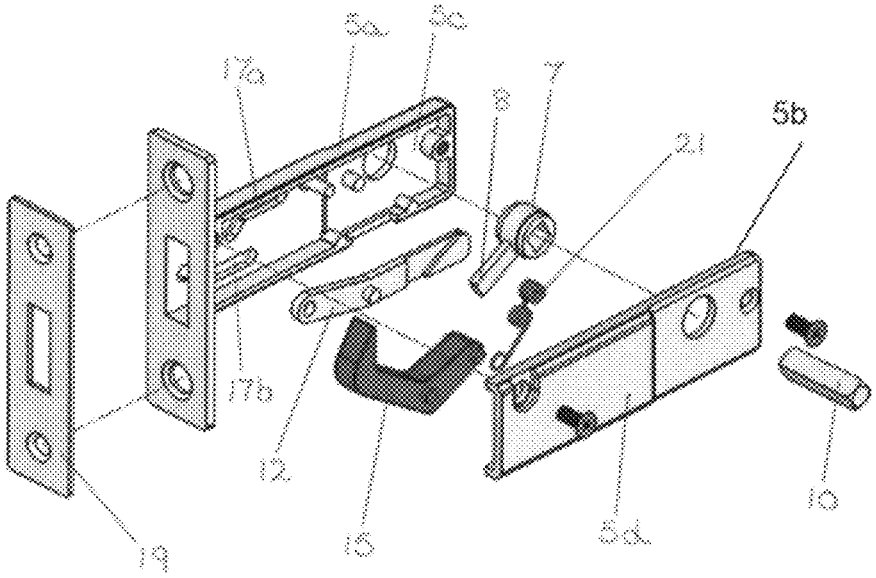
FIG. 1 illustrates a latch body and component parts in rear view (FIG. 1*a*), side plan view (FIG. 1*b*), front view (FIG. 1*c*), top view (FIG. 1*d*), perspective view (FIG. 1*e*), and exploded perspective view (FIG. 1*f*)

The figures are drawn to scale, although other relative ratios and dimensions may also be used.

DETAILED DESCRIPTION

List of parts:

1 latch mechanism
5 latch body
7 drive member
8 cam
10 spindle
12 link
15 hook
17 guide
19 face plate
21 over center spring
23 recessed cups
25 lever
26 strike plate
27 bolt head
28 strike plate assembly
29 spring (for spring loaded tongue 31)
31 tongue
33 recessed plate
35 latch casing FIG. 1 depicts a latch mechanism (1) latch body (5) supporting a drive member (7) having a cam (8) adapted for movement in response to rotation of a spindle (10).

The latch body (5) is generally of rectangular cross section, having a parallel top and bottom surface (5*a*, 5*b*) and parallel side surfaces (5*c*,5*d*). A link (12) imparts movement between the drive member (7) and a hook (15). In this embodiment the link (12) has a first end cooperating with a cam (8) integral with the drive member (7) and a second end cooperating with the hook (15).

The hook movement follows guide slots (17*a*, 17*b*) on the latch body (5). The hook (15) is shown projecting beyond the face plate (19) in FIGS. 1*b* to 1*e*. In this view an over center spring (21) urges the hook (15) into a locked position engaging a strike plate (not shown). An over center spring (21) can urge the hook (15) between a locked position in which it is engaging the strike plate, and an unlocked position wherein it is disengaged from the strike plate.

FIG. 1*f* clearly shows the configuration of the guide slots (17*a*, 17*b*) which receive protrusions in the form of bosses projecting from the hook (15). In this embodiment, each side surface (5*c*, 5*d*) of the latch body includes a first slot (17*a*) associated with vertical and horizontal movement of the hook and a second slot (17*b*) associated with vertical and horizontal movement of the hook (15). Slots (17*a*, 17*b*) are only shown in side surface (5*c*) for simplicity. However it will be readily apparent to the person skilled in the art that other configurations of slots would be suitable for use with the latch of the present disclosure.

In the configuration shown in FIG. 1, the guide facilitates the hook (15) to move between, a first position in which the hook (15) extends from the latch body (5) and engages the strike plate assembly (28) to lock the latch, a second position in which the hook (15) is disengaged from the strike plate assembly, and a third position in which the hook (15) is at least partially retracted, and may be fully retracted within the latch body (5).

FIG. 2 illustrates the latch body of FIG. 1 in combination with a pair of recessed cups (23*a*, 23*b*) located on either side of a door panel (not shown). Recessed cups (23*a*, 23*b*) are convenient for doors such as sliding doors that slide into a wall space. The recessed cup (23*a*) on the 'inside' of the door panel includes a lever (25) for manual rotation of the spindle (10) to open and close the latch in normal operation. The recessed cup (23*b*) on the 'outside' of the door includes a bolt head (27) which can be operated by a tool (such as a screw driver) in the event of an emergency, to rotate the spindle (10) and lock or unlock the latch. In the closed or locked position the hook (15) engages the strike plate (26) of the strike plate assembly (28). The strike plate assembly (28) comprises the strike plate (26), spring loaded tongue (31) and recessed plate (33). More particularly, the hook (15) engages the spring loaded (29) tongue (31) of the strike plate (26) which holds the hook (15) secure and stops rattling. The tongue (31) is housed within the recessed plate (33) which in use would be located in a door frame.

FIG. 3 illustrates the latch body and manual opening and closing means of FIG. 2 in various views. The lever (23*a*) can be manually rotated to extend or retract the hook (15) through a recess in the face plate (19) at the end of the latch body (5). In use a strike plate assembly (28) is mounted on the door frame opposite the closing edge of the door and includes a strike plate (26) having an opening into which the hook (15) can extend. When the door is closed, the hook (15) can be extended from the latch body (5), to engage the strike plate assembly (28) and retain the door in the closed position. To open the door, the hook (15) is disengaged from the strike plate assembly (28) and retracted into the latch body (5).

Figure 4:
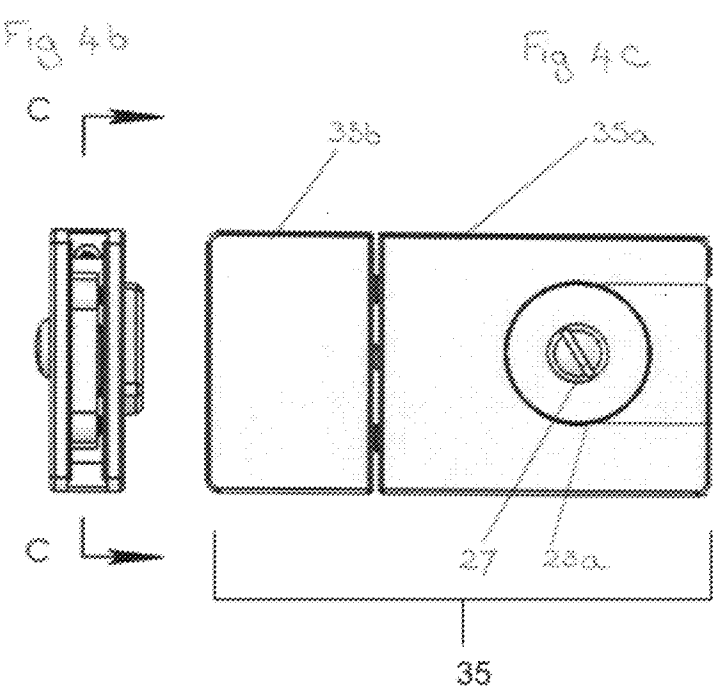
FIG. 4 illustrates the latch body and manual opening and closing means of FIGS. 2 and 3 residing within a latch casing in cross-sectional plan view (FIG. 4*a*), end on view at C-C (FIG. 4*b*), front view (FIG. 4*c*) and top view (FIG. 4*d*).
Figure 4:
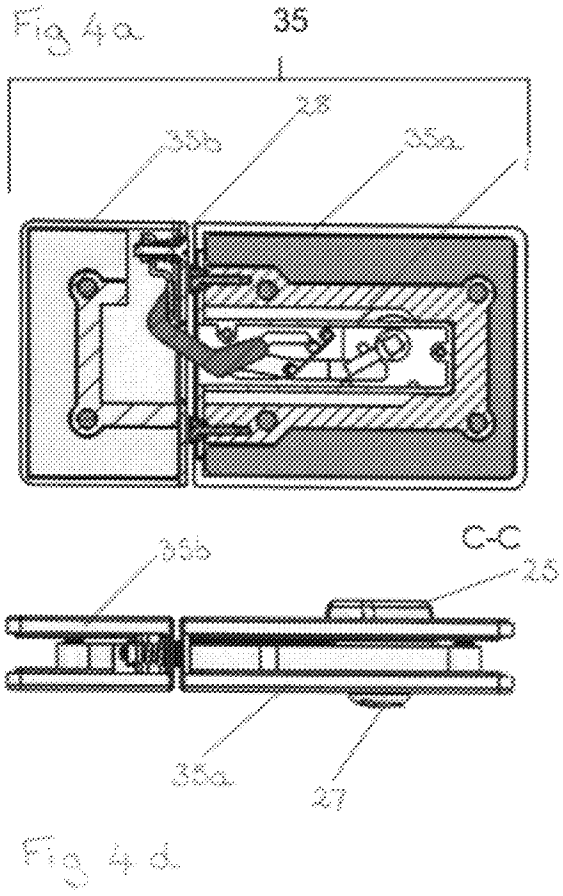

FIG. 4 illustrates the latch body and manual opening and closing means of FIGS. 2 and 3 residing within a latch casing (35) in various views. For aesthetic reasons and to keep the latch secure, the latch mechanism (1) and strike plate assembly (28) are located within the two parts of the latch casing (35*a*, 35*b*).

While specific embodiments of the disclosure have been provided, it will be understood that further modification(s) is(are) possible. This application is intended to cover any variations, uses or adaptations of the invention following in general, the principles of the disclosure and including such departures from the present disclosure as come within known or customary practice within the art to which the disclosure pertains and as may be applied to the essential features hereinbefore set forth.

As the present disclosure may be embodied in several forms without departing from the spirit of the essential characteristics of the disclosure, it should be understood that the above described embodiments are not to limit the present disclosure unless otherwise specified, but rather should be construed broadly within the spirit and scope of the disclosure as defined in the appended claims. The described embodiments are to be considered in all respects as illustrative only and not restrictive.

Various modifications and equivalent arrangements are intended to be included within the spirit and scope of the disclosure and appended claims. Therefore, the specific embodiments are to be understood to be illustrative of the many ways in which the principles of the present disclosure may be practiced. In the following claims, means-plus-function clauses are intended to cover structures as performing the defined function and not only structural equivalents, but also equivalent structures.

"Comprises/comprising" and "includes/including" when used in this specification is taken to specify the presence of stated features, integers, steps or components but does not preclude the presence or addition of one or more other features, integers, steps, components or groups thereof. Thus, unless the context clearly requires otherwise, throughout the description and the claims, the words 'comprise', 'comprising', 'includes', 'including' and the like are to be construed in an inclusive sense as opposed to an exclusive or exhaustive sense; that is to say, in the sense of "including, but not limited to".

The claims defining the invention are as follows:

1. A lock for a sliding door, the lock comprising: a drive member supported by a latch body, the drive member being adapted for movement in response to rotation of a spindle, the latch body having parallel first and second side surfaces, the surfaces each having separate first and second guide slots; and a link for imparting movement between the drive member and a hook, the hook having bosses projecting therefrom, each boss being received by a corresponding one of the first and second guide slots; wherein the first guide slots are associated with vertical and horizontal movement of the hook and the second guide slots are associated with vertical and horizontal movement of the hook, wherein an over center arrangement urges the hook between a locked position engaging a strike plate and an unlocked position wherein the hook is disengaged from the strike plate and at least partially retracted within the latch body, and wherein the bosses of the hook slide along the first guide slots and the second guide slots when the over center arrangement urges the hook between the locked position and the unlocked position.

2. The lock for a sliding door according to claim 1 wherein the first and second guide slots are configured such that the hook movement is between:

the locked position in which the hook extends from the latch body and engages the strike plate, a second position in which the hook is disengaged from the strike plate, and the unlocked position in which the hook is at least partially retracted within the latch body.

3. The lock for a sliding door according to claim 2 wherein in the unlocked position, the hook is fully retracted.

4. The lock for a sliding door according to claim 1, wherein the link has a first end cooperating with a cam on the drive member and a second end cooperating with the hook, the second end of the link being coupled with the hook between the bosses.

5. The lock for a sliding door according to claim 4 wherein the over center arrangement comprises an over center spring, wherein the spring is coupled with the latch body, and wherein the spring is further coupled with the link between the first end of the link and the second end of the link.

6. The lock for a sliding door according to claim 1, wherein the latch body further comprises parallel top and bottom surfaces.

7. A lock for a sliding door, the lock comprising: a drive member supported by a latch body, the drive member being adapted for movement in response to rotation of a spindle, the latch body having parallel first and second side surfaces, the surfaces each having separate first and second guide slots; and a link for imparting movement between the drive member and a hook, the link having a first end cooperating with a cam on the drive member and a second end cooperating with the hook, wherein the first guide slot of the first side surface receives a first boss projecting from the hook and the first guide slot of the second side surface receives a second boss projecting from the hook, the first guide slots are associated with vertical and horizontal movement of the hook, wherein the second guide slot of the first side surface receives a third boss projecting from the hook and the second guide slot of the second side surface receives a fourth boss projecting from the hook, the second guide slots are associated with vertical and horizontal movement of the hook; and wherein the first, second, third, and fourth bosses of the hook slide along the first guide slots and the second guide slots when an over center arrangement urges the hook between a locked position engaging a strike plate and an unlocked position wherein the hook is disengaged from the strike plate.

8. The lock for a sliding door according to claim 7, wherein the second end of the link is coupled with the hook between the bosses received by the first guide slots and the bosses received by the second guide slots.

9. The lock for a sliding door according to claim 7, wherein the over center arrangement comprises an over center spring, wherein the spring is coupled with the latch body, and wherein the spring is further coupled with the link between the first end of the link and the second end of the link.

10. A lock for a sliding door, the lock comprising: a drive member supported by a latch body, the latch body having parallel first and second side surfaces, the surfaces each having separate first and second guide slots, the drive member being adapted for movement in response to rotation of a spindle; a hook having a first end adapted to engage and disengage from a strike plate in a door frame and a second end having a plurality of bosses projecting therefrom, each boss being received by a corresponding one of the first and second guide slots of the first and second side surfaces of the latch body; and a link for imparting movement between the drive member and the hook, the link having a first end cooperating with a cam on the drive member and a second end cooperating with the hook, wherein the bosses of the hook slide along the first guide slots and the second guide slots when an over center arrangement urges the hook between a locked position in which the first end of the hook engages the strike plate and an unlocked position wherein the first end of the hook is disengaged from the strike plate during operation.

11. The lock for a sliding door according to claim 10, wherein the second end of the link is coupled with the hook between the bosses received by the first guide slots and the bosses received by the second guide slots.

12. The lock for a sliding door according to claim 10, wherein the over center arrangement is coupled with the latch body, and wherein the over center arrangement is further coupled with the link between the first end of the link and the second end of the link.

* * * * *